US008075668B2

(12) United States Patent
Delmotte et al.

(10) Patent No.: US 8,075,668 B2
(45) Date of Patent: Dec. 13, 2011

(54) DRAINAGE SYSTEM FOR COMPRESSOR SEPARATORS

(75) Inventors: Scott J. Delmotte, Tioga, PA (US); Jon T. Vine, Painted Post, NY (US); Thomas D. O'Leary, Painted Post, NY (US)

(73) Assignee: Dresser-Rand Company, Olean, NY (US)

( * ) Notice: Subject to any disclaimer, the term of this patent is extended or adjusted under 35 U.S.C. 154(b) by 1231 days.

(21) Appl. No.: 11/392,052

(22) Filed: Mar. 29, 2006

(65) Prior Publication Data

US 2006/0222515 A1 Oct. 5, 2006

Related U.S. Application Data

(60) Provisional application No. 60/666,034, filed on Mar. 29, 2005.

(51) Int. Cl.
*B01D 46/46* (2006.01)

(52) U.S. Cl. ..... 95/19; 417/228; 417/440; 95/24; 96/406; 96/408; 96/411; 96/412; 96/421; 55/423; 55/DIG. 17

(58) Field of Classification Search ..... 55/423, 55/DIG. 17; 96/408–412, 421, 397; 95/18; 417/228, 440

See application file for complete search history.

(56) References Cited

U.S. PATENT DOCUMENTS

| | | | |
|---|---|---|---|
| 815,812 | A | 3/1906 | Gow |
| 1,057,613 | A | 4/1913 | Baldwin |
| 1,061,656 | A | 5/1913 | Black |
| 1,480,775 | A | 1/1924 | Marien |
| 1,622,768 | A | 3/1927 | Cook et al. |
| 1,642,454 | A | 9/1927 | Malmstrom |
| 2,006,244 | A | 6/1935 | Kopsa |
| 2,300,766 | A | 11/1942 | Baumann |

(Continued)

FOREIGN PATENT DOCUMENTS

CA 2647511 10/2007

(Continued)

OTHER PUBLICATIONS

"Technical Manual—High Pressure Air Compressor Model 13NL45", NAVSEA S6220-AT-MMA-010/93236, Oct. 28, 1991, pp. 3-23 to 3-32, Electric Boat Corporation, Groton, CT 06340.

(Continued)

*Primary Examiner* — Duane Smith
*Assistant Examiner* — Ives Wu
(74) *Attorney, Agent, or Firm* — Edmonds & Nolte, PC

(57) ABSTRACT

A drainage system is for a compressor assembly that includes at least one separator with a chamber. The system includes a drain valve fluidly coupled with the separator chamber and adjustable between open and closed states. An actuator is operatively coupled with and adjusts the valve between the open and closed states or/and a sensor senses when the valve is open. A pressure sensor is configured to sense pressure within the chamber and a logic circuit is coupled with the pressure sensor and determines when the valve either has been or should have been adjusted to the open state. The logic circuit also generates an output signal or/and operates a device when the chamber pressure remains substantially constant or varies by less than a predetermined amount subsequent to the valve being opened and/or when the chamber pressure varies by at least the predetermined amount after the valve is opened.

15 Claims, 5 Drawing Sheets

U.S. PATENT DOCUMENTS

| | | | | | |
|---|---|---|---|---|---|
| 2,328,031 | A | | 8/1943 | Risley | |
| 2,345,437 | A | | 3/1944 | Tinker | |
| 2,347,939 | A | * | 5/1944 | Down | 137/102 |
| 2,383,244 | A | * | 8/1945 | Farmer | 137/204 |
| 2,602,462 | A | * | 7/1952 | Barrett | 137/204 |
| 2,811,303 | A | | 10/1957 | Ault et al. | |
| 2,836,117 | A | | 5/1958 | Lankford | |
| 2,868,565 | A | | 1/1959 | Suderow | |
| 2,897,917 | A | | 8/1959 | Hunter | |
| 2,932,360 | A | | 4/1960 | Hungate | |
| 2,954,841 | A | | 10/1960 | Reistle | |
| 2,955,673 | A | * | 10/1960 | Kennedy et al. | 96/113 |
| 3,044,657 | A | | 7/1962 | Horton | |
| 3,175,572 | A | * | 3/1965 | Brooks et al. | 137/204 |
| 3,191,364 | A | | 6/1965 | Sylvan | |
| 3,198,214 | A | | 8/1965 | Lorenz | |
| 3,204,696 | A | | 9/1965 | De Priester et al. | |
| 3,213,794 | A | | 10/1965 | Adams | |
| 3,220,245 | A | | 11/1965 | Van Winkle | |
| 3,273,325 | A | | 9/1966 | Gerhold | |
| 3,341,111 | A | * | 9/1967 | Sanders | 137/115.24 |
| 3,352,577 | A | | 11/1967 | Medney | |
| 3,395,511 | A | * | 8/1968 | Akerman | 95/41 |
| 3,420,434 | A | | 1/1969 | Swearingen | |
| 3,431,747 | A | | 3/1969 | Hasheimi et al. | |
| 3,454,163 | A | | 7/1969 | Read | |
| 3,487,432 | A | | 12/1969 | Jenson | |
| 3,490,209 | A | | 1/1970 | Fernandes et al. | |
| 3,500,614 | A | | 3/1970 | Soo | |
| 3,578,342 | A | | 5/1971 | Satterthwaite et al. | |
| 3,628,812 | A | | 12/1971 | Larraide et al. | |
| 3,646,727 | A | * | 3/1972 | Wachsmuth | 95/22 |
| 3,672,733 | A | | 6/1972 | Arsenius et al. | |
| 3,694,103 | A | * | 9/1972 | Cohen et al. | 415/169.2 |
| 3,814,486 | A | | 6/1974 | Schurger | |
| 3,829,179 | A | | 8/1974 | Kurita et al. | |
| 3,915,673 | A | | 10/1975 | Tamai et al. | |
| 3,975,123 | A | | 8/1976 | Schibbye | |
| 4,033,647 | A | | 7/1977 | Beavers | |
| 4,043,353 | A | * | 8/1977 | Shirey | 137/204 |
| 4,059,364 | A | | 11/1977 | Anderson et al. | |
| 4,078,809 | A | | 3/1978 | Garrick et al. | |
| 4,087,261 | A | | 5/1978 | Hays | |
| 4,103,899 | A | | 8/1978 | Turner | |
| 4,112,687 | A | | 9/1978 | Dixon | |
| 4,117,359 | A | | 9/1978 | Wehde | |
| 4,135,542 | A | * | 1/1979 | Chisholm | 137/204 |
| 4,141,283 | A | | 2/1979 | Swanson et al. | |
| 4,146,261 | A | | 3/1979 | Edmaier et al. | |
| 4,165,622 | A | | 8/1979 | Brown, Jr. | |
| 4,174,925 | A | | 11/1979 | Pfenning et al. | |
| 4,182,480 | A | | 1/1980 | Theyse et al. | |
| 4,197,990 | A | * | 4/1980 | Carberg et al. | 236/1 R |
| 4,205,927 | A | | 6/1980 | Simmons | |
| 4,227,373 | A | | 10/1980 | Amend et al. | |
| 4,258,551 | A | | 3/1981 | Ritzi | |
| 4,259,045 | A | | 3/1981 | Teruyama | |
| 4,278,200 | A | | 7/1981 | Gunnewig | |
| 4,298,311 | A | | 11/1981 | Ritzi | |
| 4,303,372 | A | * | 12/1981 | Caffrey | 415/169.2 |
| 4,333,748 | A | | 6/1982 | Erickson | |
| 4,334,592 | A | | 6/1982 | Fair | |
| 4,336,693 | A | | 6/1982 | Hays et al. | |
| 4,339,923 | A | | 7/1982 | Hays et al. | |
| 4,347,900 | A | | 9/1982 | Barrington | |
| 4,363,608 | A | | 12/1982 | Mulders | |
| 4,374,583 | A | | 2/1983 | Barrington | |
| 4,375,975 | A | | 3/1983 | McNicholas | |
| 4,382,804 | A | | 5/1983 | Mellor | |
| 4,384,724 | A | | 5/1983 | Derman et al. | |
| 4,391,102 | A | | 7/1983 | Studhalter et al. | |
| 4,396,361 | A | | 8/1983 | Fraser | |
| 4,432,470 | A | | 2/1984 | Sopha | |
| 4,438,638 | A | | 3/1984 | Hays et al. | |
| 4,441,322 | A | | 4/1984 | Ritzi | |
| 4,442,925 | A | | 4/1984 | Fukushima et al. | |
| 4,453,893 | A | * | 6/1984 | Hutmaker | 417/279 |
| 4,453,894 | A | * | 6/1984 | Ferone et al. | 417/332 |
| 4,463,567 | A | | 8/1984 | Amend et al. | |
| 4,468,234 | A | | 8/1984 | McNicholas | |
| 4,471,795 | A | | 9/1984 | Linhardt | |
| 4,477,223 | A | | 10/1984 | Giroux | |
| 4,502,839 | A | | 3/1985 | Maddox et al. | |
| 4,511,309 | A | | 4/1985 | Maddox | |
| 4,531,888 | A | | 7/1985 | Buchelt | |
| 4,536,134 | A | | 8/1985 | Huiber | |
| 4,541,531 | A | | 9/1985 | Brule | |
| 4,541,607 | A | | 9/1985 | Hotger | |
| 4,573,527 | A | | 3/1986 | McDonough | |
| 4,574,815 | A | | 3/1986 | West et al. | |
| 4,648,806 | A | | 3/1987 | Alexander | |
| 4,687,017 | A | | 8/1987 | Danko et al. | |
| 4,737,081 | A | | 4/1988 | Nakajima et al. | |
| 4,752,185 | A | | 6/1988 | Butler et al. | |
| 4,807,664 | A | * | 2/1989 | Wilson et al. | 137/624.11 |
| 4,813,495 | A | | 3/1989 | Leach | |
| 4,821,737 | A | | 4/1989 | Nelson | |
| 4,826,403 | A | | 5/1989 | Catlow | |
| 4,830,331 | A | | 5/1989 | Vindum | |
| 4,832,709 | A | | 5/1989 | Nagyszalanczy | |
| 4,904,284 | A | | 2/1990 | Hanabusa | |
| 4,984,830 | A | | 1/1991 | Saunders | |
| 5,007,328 | A | | 4/1991 | Otterman | |
| 5,024,585 | A | | 6/1991 | Kralovec | |
| 5,043,617 | A | | 8/1991 | Rostron | |
| 5,044,701 | A | | 9/1991 | Watanabe et al. | |
| 5,045,046 | A | | 9/1991 | Bond | |
| 5,054,995 | A | | 10/1991 | Kaseley et al. | |
| 5,064,452 | A | | 11/1991 | Yano et al. | |
| 5,080,137 | A | | 1/1992 | Adams | |
| 5,163,895 | A | * | 11/1992 | Titus | 494/36 |
| 5,190,440 | A | | 3/1993 | Maier et al. | |
| 5,202,024 | A | | 4/1993 | Andersson et al. | |
| 5,202,026 | A | | 4/1993 | Lema | |
| 5,203,891 | A | | 4/1993 | Lema | |
| 5,207,810 | A | | 5/1993 | Sheth | |
| 5,211,427 | A | | 5/1993 | Washizu | |
| 5,246,346 | A | | 9/1993 | Schiesser | |
| 5,285,123 | A | | 2/1994 | Kataoka et al. | |
| 5,306,051 | A | | 4/1994 | Loker et al. | |
| 5,337,779 | A | * | 8/1994 | Fukuhara | 137/187 |
| 5,378,121 | A | | 1/1995 | Hackett | |
| 5,385,446 | A | | 1/1995 | Hays | |
| 5,421,708 | A | | 6/1995 | Utter | |
| 5,443,581 | A | | 8/1995 | Malone | |
| 5,484,521 | A | | 1/1996 | Kramer | |
| 5,496,394 | A | | 3/1996 | Nied | |
| 5,500,039 | A | | 3/1996 | Mori et al. | |
| 5,525,034 | A | | 6/1996 | Hays | |
| 5,525,146 | A | | 6/1996 | Straub | |
| 5,531,811 | A | | 7/1996 | Kloberdanz | |
| 5,538,259 | A | | 7/1996 | Uhrner et al. | |
| 5,542,831 | A | | 8/1996 | Scarfone | |
| 5,575,309 | A | * | 11/1996 | Connell | 137/556 |
| 5,585,000 | A | | 12/1996 | Sassi | |
| 5,605,172 | A | | 2/1997 | Schubert et al. | |
| 5,628,623 | A | | 5/1997 | Skaggs | |
| 5,634,492 | A | | 6/1997 | Steinruck et al. | |
| 5,640,472 | A | | 6/1997 | Meinzer et al. | |
| 5,641,280 | A | | 6/1997 | Timuska | |
| 5,653,347 | A | | 8/1997 | Larsson | |
| 5,664,420 | A | | 9/1997 | Hays | |
| 5,682,759 | A | | 11/1997 | Hays | |
| 5,683,235 | A | | 11/1997 | Welch | |
| 5,685,691 | A | | 11/1997 | Hays | |
| 5,687,249 | A | | 11/1997 | Kato | |
| 5,693,125 | A | | 12/1997 | Dean | |
| 5,703,424 | A | | 12/1997 | Dorman | |
| 5,709,528 | A | | 1/1998 | Hablanian | |
| 5,713,720 | A | | 2/1998 | Barhoum | |
| 5,720,799 | A | | 2/1998 | Hays | |
| 5,749,391 | A | * | 5/1998 | Loutzenhiser | 137/204 |
| 5,750,040 | A | | 5/1998 | Hays | |
| 5,775,882 | A | | 7/1998 | Kiyokawa et al. | |
| 5,779,619 | A | | 7/1998 | Borgstrom et al. | |
| 5,795,135 | A | | 8/1998 | Nyilas et al. | |
| 5,800,092 | A | | 9/1998 | Nill et al. | |

5,848,616 A 12/1998 Vogel et al.
5,850,857 A 12/1998 Simpson
5,853,585 A 12/1998 Nesseth
5,863,023 A 1/1999 Evans et al.
5,899,435 A 5/1999 Mitsch et al.
5,935,053 A 8/1999 Strid
5,938,803 A 8/1999 Dries
5,938,819 A 8/1999 Seery
5,946,915 A 9/1999 Hays
5,951,066 A 9/1999 Lane et al.
5,965,022 A 10/1999 Gould
5,967,746 A 10/1999 Hagi et al.
5,971,702 A 10/1999 Afton et al.
5,971,907 A 10/1999 Johannemann et al.
5,980,218 A 11/1999 Takahashi et al.
5,988,524 A 11/1999 Odajima et al.
6,027,311 A * 2/2000 Hill et al. ..... 417/53
6,035,934 A 3/2000 Stevenson et al.
6,059,539 A 5/2000 Nyilas et al.
6,068,447 A * 5/2000 Foege ..... 417/12
6,090,174 A 7/2000 Douma et al.
6,090,299 A 7/2000 Hays et al.
6,113,675 A 9/2000 Branstetter
6,122,915 A 9/2000 Hays
6,123,363 A 9/2000 Burgard et al.
6,145,844 A 11/2000 Waggott
6,149,825 A 11/2000 Gargas
6,151,881 A 11/2000 Ai et al.
6,196,962 B1 3/2001 Purvey et al.
6,206,202 B1 3/2001 Galk et al.
6,214,075 B1 4/2001 Filges et al.
6,217,637 B1 4/2001 Toney et al.
6,227,379 B1 5/2001 Nesseth
6,277,278 B1 8/2001 Conrad et al.
6,312,021 B1 11/2001 Thomas
6,314,738 B1 11/2001 Hays
6,372,006 B1 4/2002 Pregenzer et al.
6,375,437 B1 4/2002 Nolan
6,383,262 B1 5/2002 Marthinsen et al.
6,394,764 B1 5/2002 Samurin
6,398,973 B1 6/2002 Saunders et al.
6,402,465 B1 6/2002 Maier
6,426,010 B1 7/2002 Lecoffre et al.
6,464,469 B1 10/2002 Grob et al.
6,467,988 B1 10/2002 Czachor et al.
6,468,426 B1 10/2002 Klass
6,485,536 B1 11/2002 Masters
6,530,484 B1 3/2003 Bosman
6,530,979 B2 3/2003 Firey
6,531,066 B1 3/2003 Saunders et al.
6,537,035 B2 3/2003 Shumway
6,540,917 B1 4/2003 Richards et al.
6,547,037 B2 4/2003 Kuzdzal
6,592,654 B2 7/2003 Brown
6,596,046 B2 7/2003 Conrad et al.
6,599,086 B2 7/2003 Soja
6,607,348 B2 8/2003 Jean
6,616,719 B1 * 9/2003 Sun et al. ..... 55/315.2
6,617,731 B1 9/2003 Goodnick
6,629,825 B2 10/2003 Stickland et al.
6,631,617 B1 10/2003 Dreiman et al.
6,658,986 B2 12/2003 Pitla et al.
6,659,143 B1 12/2003 Taylor et al.
6,669,845 B2 12/2003 Klass
6,688,802 B2 2/2004 Ross et al.
6,707,200 B2 3/2004 Carroll et al.
6,718,955 B1 4/2004 Knight
6,719,830 B2 4/2004 Illingworth et al.
6,764,284 B2 7/2004 Oehman, Jr.
6,776,812 B2 8/2004 Komura et al.
6,802,693 B2 10/2004 Reinfeld et al.
6,802,881 B2 10/2004 Illingworth et al.
6,811,713 B2 11/2004 Arnaud
6,817,846 B2 11/2004 Bennitt
6,837,913 B2 1/2005 Schilling et al.
6,843,836 B2 1/2005 Kitchener
6,878,187 B1 4/2005 Hays et al.
6,893,208 B2 5/2005 Frosini et al.
6,907,933 B2 6/2005 Choi et al.
6,979,358 B2 12/2005 Ekker
7,000,893 B2 * 2/2006 Yakushi ..... 251/129.04
7,001,448 B1 2/2006 West
7,013,978 B2 3/2006 Appleford et al.
7,022,150 B2 4/2006 Borgstrom et al.
7,022,153 B2 4/2006 McKenzie
7,025,890 B2 4/2006 Moya
7,033,410 B2 4/2006 Hilpert et al.
7,033,411 B2 4/2006 Carlsson et al.
7,056,363 B2 6/2006 Carlsson et al.
7,063,465 B1 6/2006 Wilkes et al.
7,112,036 B2 9/2006 Lubell et al.
7,131,292 B2 11/2006 Ikegami et al.
7,144,226 B2 12/2006 Pugnet et al.
7,159,723 B2 1/2007 Hilpert et al.
7,160,518 B2 1/2007 Chen et al.
7,169,305 B2 1/2007 Gomez
7,185,447 B2 3/2007 Arbeiter
7,204,241 B2 4/2007 Thompson
7,241,392 B2 7/2007 Maier
7,244,111 B2 7/2007 Suter et al.
7,258,713 B2 8/2007 Eubank et al.
7,270,145 B2 9/2007 Koezler
7,288,202 B2 10/2007 Maier
7,314,560 B2 1/2008 Yoshida et al.
7,323,023 B2 1/2008 Michele et al.
7,328,749 B2 2/2008 Reitz
7,335,313 B2 2/2008 Moya
7,377,110 B2 5/2008 Sheridan et al.
7,381,235 B2 6/2008 Koene et al.
7,396,373 B2 7/2008 Lagerstedt et al.
7,399,412 B2 7/2008 Keuschnigg
7,435,290 B2 10/2008 Lane et al.
7,445,653 B2 11/2008 Trautmann et al.
7,470,299 B2 12/2008 Han et al.
7,473,083 B2 1/2009 Oh et al.
7,479,171 B2 1/2009 Cho et al.
7,494,523 B2 2/2009 Oh et al.
7,501,002 B2 3/2009 Han et al.
7,520,210 B2 4/2009 Theodore, Jr. et al.
7,575,422 B2 8/2009 Bode et al.
7,578,863 B2 8/2009 Becker et al.
7,591,882 B2 9/2009 Harazim
7,594,941 B2 9/2009 Zheng et al.
7,594,942 B2 9/2009 Polderman
7,610,955 B2 11/2009 Irwin, Jr.
7,628,836 B2 12/2009 Baronet et al.
7,637,699 B2 12/2009 Albrecht
7,674,377 B2 3/2010 Crew
7,677,308 B2 3/2010 Kolle
7,708,537 B2 5/2010 Bhatia et al.
7,708,808 B1 5/2010 Heumann
7,744,663 B2 6/2010 Wallace
7,748,079 B2 7/2010 McDowell et al.
7,766,989 B2 8/2010 Lane et al.
7,811,344 B1 10/2010 Duke et al.
7,811,347 B2 10/2010 Carlsson et al.
7,815,415 B2 10/2010 Kanezawa et al.
7,824,458 B2 11/2010 Borgstrom et al.
7,824,459 B2 11/2010 Borgstrom et al.
7,846,228 B1 12/2010 Saaski et al.
2002/0009361 A1 1/2002 Reichert et al.
2003/0029318 A1 2/2003 Firey
2003/0035718 A1 2/2003 Langston et al.
2003/0136094 A1 7/2003 Illingworth et al.
2004/0007261 A1 1/2004 Cornwell
2004/0170505 A1 9/2004 Lenderink et al.
2005/0173337 A1 8/2005 Costinel
2006/0065609 A1 3/2006 Arthur
2006/0090430 A1 5/2006 Trautman et al.
2006/0096933 A1 5/2006 Maier
2006/0157251 A1 7/2006 Stinessen et al.
2006/0157406 A1 7/2006 Maier
2006/0193728 A1 8/2006 Lindsey et al.
2006/0222515 A1 10/2006 Delmotte et al.
2006/0230933 A1 10/2006 Harazim
2006/0239831 A1 10/2006 Garris, Jr.
2006/0254659 A1 11/2006 Ballott et al.
2006/0275160 A1 12/2006 Leu et al.

| | | | |
|---|---|---|---|
| 2007/0029091 | A1 | 2/2007 | Stinessen et al. |
| 2007/0036646 | A1 | 2/2007 | Nguyen et al. |
| 2007/0051245 | A1 | 3/2007 | Yun |
| 2007/0062374 | A1 | 3/2007 | Kolle |
| 2007/0065317 | A1 | 3/2007 | Stock |
| 2007/0084340 | A1 | 4/2007 | Dou et al. |
| 2007/0140870 | A1 | 6/2007 | Fukanuma et al. |
| 2007/0151922 | A1 | 7/2007 | Mian |
| 2007/0163215 | A1 | 7/2007 | Lagerstadt |
| 2007/0172363 | A1 | 7/2007 | Laboube et al. |
| 2007/0196215 | A1 | 8/2007 | Frosini et al. |
| 2007/0227969 | A1 | 10/2007 | Dehaene et al. |
| 2007/0294986 | A1 | 12/2007 | Beetz |
| 2008/0031732 | A1 | 2/2008 | Peer et al. |
| 2008/0039732 | A9 | 2/2008 | Bowman |
| 2008/0246281 | A1 | 10/2008 | Agrawal et al. |
| 2008/0315812 | A1 | 12/2008 | Balboul |
| 2009/0013658 | A1 | 1/2009 | Borgstrom et al. |
| 2009/0015012 | A1 | 1/2009 | Metzler et al. |
| 2009/0025562 | A1 | 1/2009 | Hallgren et al. |
| 2009/0025563 | A1 | 1/2009 | Borgstrom et al. |
| 2009/0151928 | A1 | 6/2009 | Lawson |
| 2009/0169407 | A1 | 7/2009 | Yun |
| 2009/0173095 | A1 | 7/2009 | Bhatia et al. |
| 2009/0266231 | A1 | 10/2009 | Franzen et al. |
| 2009/0304496 | A1 | 12/2009 | Maier |
| 2009/0321343 | A1 | 12/2009 | Maier |
| 2009/0324391 | A1 | 12/2009 | Maier |
| 2010/0007133 | A1 | 1/2010 | Maier |
| 2010/0007283 | A1 | 1/2010 | Johal et al. |
| 2010/0021292 | A1 | 1/2010 | Maier et al. |
| 2010/0038309 | A1 | 2/2010 | Maier |
| 2010/0043288 | A1 | 2/2010 | Wallace |
| 2010/0043364 | A1 | 2/2010 | Curien |
| 2010/0044966 | A1 | 2/2010 | Majot et al. |
| 2010/0072121 | A1 | 3/2010 | Maier |
| 2010/0074768 | A1 | 3/2010 | Maier |
| 2010/0083690 | A1 | 4/2010 | Sato et al. |
| 2010/0090087 | A1 | 4/2010 | Maier |
| 2010/0143172 | A1 | 6/2010 | Sato et al. |
| 2010/0163232 | A1 | 7/2010 | Kolle |
| 2010/0183438 | A1 | 7/2010 | Maier et al. |
| 2010/0239419 | A1 | 9/2010 | Maier et al. |
| 2010/0239437 | A1 | 9/2010 | Maier |
| 2010/0247299 | A1 | 9/2010 | Maier |
| 2010/0257827 | A1 | 10/2010 | Lane et al. |
| 2011/0017307 | A1 | 1/2011 | Kidd et al. |
| 2011/0061536 | A1 | 3/2011 | Maier et al. |

FOREIGN PATENT DOCUMENTS

| | | | |
|---|---|---|---|
| EP | 301285 | | 10/1991 |
| EP | 1582703 | | 10/2005 |
| EP | 2013479 | | 1/2009 |
| EP | 7838631.5 | | 12/2009 |
| GB | 2323639 | | 9/1998 |
| GB | 2337561 | | 11/1999 |
| JP | 54099206 | | 1/1978 |
| JP | 08 068501 | | 3/1996 |
| JP | 8-284961 | A | 11/1996 |
| JP | 2002 242699 | | 8/2002 |
| JP | 3711028 | | 10/2005 |
| JP | 2005291202 | | 10/2005 |
| KR | 2009085521 | | 2/2008 |
| MX | 2008012579 | | 12/2008 |
| WO | 9524563 | | 9/1995 |
| WO | 0117096 | | 3/2001 |
| WO | 2007043889 | | 4/2007 |
| WO | 2007103248 | | 9/2007 |
| WO | 2007120506 | | 10/2007 |
| WO | 2008036221 | | 3/2008 |
| WO | 2008039446 | | 3/2008 |
| WO | 2008039491 | | 4/2008 |
| WO | 2008039731 | | 4/2008 |
| WO | 2008039732 | | 4/2008 |
| WO | 2008039733 | | 4/2008 |
| WO | 2008039734 | | 4/2008 |
| WO | 2008036394 | | 7/2008 |
| WO | 2009111616 | | 9/2009 |
| WO | 2009158252 | | 12/2009 |
| WO | 2009158253 | | 12/2009 |
| WO | 2010083416 | | 7/2010 |
| WO | 2010083427 | | 7/2010 |
| WO | 2010107579 | | 9/2010 |
| WO | 2010110992 | | 9/2010 |
| WO | 2011034764 | | 3/2011 |

OTHER PUBLICATIONS

Technical Manual—High Pressure Air Compressor Model 13NL45; Navsea S6220-AT-MMA-010/93236, pp. 3-23 to 3-32, Electric Boat Corporation, Groton, CT 06340, Oct. 28, 1991.

PCT/US2007/008149 International Preliminary Report on Patentability dated Sep. 30, 2008.

PCT/US2007/008149 International Search Report and Written Opinion dated Jul. 17, 2008.

PCT/US2007/020101 International Preliminary Report on Patentability dated Apr. 2, 2009.

PCT/US2007/020101 International Search Report dated Apr. 29, 2008.

PCT/US2007/020101 Written Opinion dated Mar. 19, 2009.

PCT/US2007/020471 International Preliminary Report on Patentability dated Apr. 2, 2009.

PCT/US2007/020471 International Search Report and Written Opinion dated Apr. 1, 2008.

PCT/US2007/020659 International Preliminary Report on Patentability dated Mar. 31, 2009.

PCT/US2007/020659 International Search Report and Written Opinion dated Sep. 17, 2008.

PCT/US2007/020768 International Preliminary Report on Patentability dated Mar. 31, 2009.

PCT/US2007/020768 International Search Report and Written Opinion dated Mar. 3, 2008.

PCT/US2007/079348 International Preliminary Report on Patentability dated Mar. 31, 2009.

PCT/US2007/079348 International Search Report dated Apr. 11, 2008.

PCT/US2007/079348 Written Opinion dated Jan. 25, 2008.

PCT/US2007/079349 International Preliminary Report on Patentability dated Mar. 31, 2009.

PCT/US2007/079349 International Search Report and Written Opinion dated Apr. 2, 2008.

PCT/US2007/079350 International Preliminary Report on Patentability dated Mar. 31, 2009.

PCT/US2007/079350 International Search Report dated Jul. 17, 2008.

PCT/US2007/079350 Written Opinion dated Mar. 25, 2009.

PCT/US2007/079352 International Preliminary Report on Patentability dated Mar. 31, 2009.

PCT/US2007/079352 International Search Report and Written Opinion dated Aug. 27, 2008.

PCT/US2009/036142 International Preliminary Report on Patentability dated Sep. 16, 2010.

PCT/US2009/036142 International Search Report dated Jan. 7, 2010.

PCT/US2009/036142 Written Opinion dated May 11, 2009.

PCT/US2009/047662 International Preliminary Report on Patentability dated Jan. 13, 2011.

PCT/US2009/047662 Written Opinion dated Aug. 20, 2009.

PCT/US2010/021199 International Search Report and Written Opinion dated Mar. 22, 2010.

PCT/US2010/021199 International Preliminary Report on Patentability dated Mar. 29, 2011.

PCT/US2010/021218 International Search Report and Written Opinion dated Mar. 23, 2010.

PCT/US2010/021218 International Report on Patentability dated Feb. 2, 2011.

PCT/US2010/025650 International Search Report and Written Opinion dated Apr. 22, 2010.

PCT/US2010/025650 International Report on Patentability dated Mar. 14, 2011.

PCT/US2010/025952 International Search Report and Written Opinion dated Apr. 12, 2010.

PCT/US2010/025952 International Report on Patentability dated Mar. 14, 2011.

* cited by examiner

DRAINAGE SYSTEM FOR COMPRESSOR SEPARATORS

This application claims the benefit of U.S. Provisional Application No. 60/666,034, filed on Mar. 29, 2005, the entire contents of which are incorporated by reference herein.

BACKGROUND OF THE INVENTION

The present invention relates to fluid machinery, and more specifically to drainage systems for compressors.

Compressors typically include one or more separators each fluidly connected with each "stage" of the compressor. These separators are provided to remove liquid from a compressed fluid, such as air, so that the fluid is substantially gaseous. As such, liquid collects in each separator, which must be periodically removed to prevent diminished performance of the separator. Typically, a drain valve is fluidly connected with the chamber of each separator, and these valves are periodically opened to evacuate liquid from the associated chamber. As a variety of faults may prevent the liquid from being evacuated, such as a failure of one or more automatically-operated valves to open as directed or an obstruction in the valve or a fluid line connecting the valve with the chamber, it is important to ensure that the liquid is actually drained from each separator.

SUMMARY OF THE INVENTION

In one aspect, the present invention is a drainage system for a compressor assembly, the compressor assembly including at least one separator with a separator chamber. The drainage system comprises a drain valve fluidly coupled with the separator chamber, the valve being adjustable between an open state and a closed state. An actuator is operatively coupled with and configured to adjust the valve between the open and closed states or/and a sensor is configured to sense when the valve is in the open state. A pressure sensor is configured to sense pressure within the chamber. Further, a logic circuit is coupled with the pressure sensor and is configured to determine when the valve either has been adjusted to the open state or should have been adjusted to the open state. The logic circuit is further configured to generate an output signal or/and to operate a device when the chamber pressure remains substantially constant or varies by less than a predetermined amount subsequent to the valve being adjusted to the open state and/or when the chamber pressure varies by at least the predetermined amount subsequent to the valve being adjusted to the open state.

In another aspect, the present invention is again a drainage system for a compressor assembly, the compressor assembly including at least one separator with a separator chamber. The drainage system comprises a drain valve fluidly coupled with the separator chamber, the valve being adjustable between an open state and a closed state, and a pressure sensor configured to sense pressure within the chamber. The drainage system further comprises monitoring means for determining when the valve has been adjusted to the open state and for generating an output signal when the chamber pressure remains substantially constant subsequent to the valve being adjusted to the open state.

In a further aspect, the present invention is a method of operating a drainage system for a compressor assembly, the compressor assembly including at least one separator with a separator chamber. The method comprising the steps of: providing a drain valve fluidly coupled with the chamber, the valve being adjustable between an open state and a closed state; sensing pressure sensor within the chamber; determining when the valve has been adjusted to the open state; and generating an output signal when the chamber pressure remains substantially constant subsequent to the valve being adjusted to the open state.

In yet another aspect, the present invention is again a drainage system for a compressor assembly, the compressor assembly including at least one separator with a chamber. The drainage system comprises a drain valve fluidly coupled with the separator chamber, the valve being adjustable between an open state and a closed state and an actuator is configured to adjust the valve between the open and closed states. A pressure sensor is configured to sense pressure within the separator chamber and a logic circuit coupled with the pressure sensor and with the actuator. The logic circuit is configured to periodically adjust the valve to the open state upon the expiration of a predetermined amount of time and to determine chamber pressure generally at the expiration of each time period. Further, the logic circuit is also configured to generate an output signal and/or operate a device when the chamber pressure either remains substantially constant or varies by less than a predetermined amount generally at the expiration of each time period or/and when the chamber pressure varies by at least the predetermined amount generally at the expiration of each time period.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings.

DETAILED DESCRIPTION OF THE INVENTION

Figure 1:
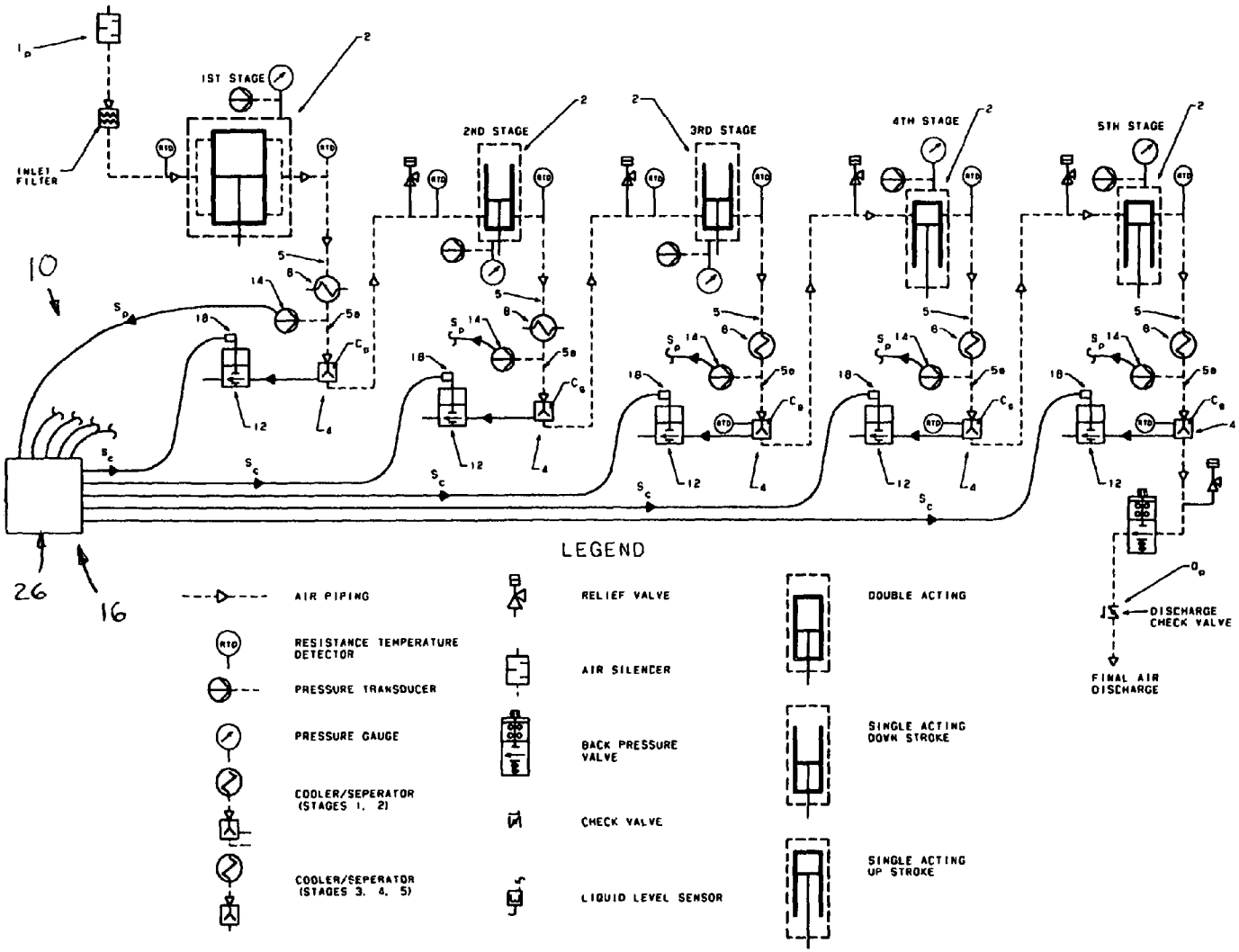
FIG. 1 is a schematic view of a multistage compressor having a drainage system in accordance with the present invention.

Referring now to the drawings in detail, wherein like numbers are used to indicate like elements throughout, there is shown in FIGS. 1-5 a drainage system 10 for a compressor assembly 1. The compressor assembly 1 includes at least one and preferably a plurality of compressor units 2, at least one motor 3 configured to operate the compressor unit(s) 2, and at least one and preferably a plurality of separators 4 each having a separator chamber $C_S$. The separator chambers $C_S$ are each fluidly connected with the associated compressor unit 2 by a separate fluid line 5 and are configured to contain a quantity of liquid. The drainage system 10 basically comprises at least one and preferably a plurality of drain valves 12 each fluidly coupled with one of the separator chambers $C_S$, at least one and preferably a plurality of pressure sensors 14 each configured to sense pressure $P_C$ within a separate one of the chambers $C_S$, and a logic circuit 16. Each drain valve 12 is adjustable between an open state and a closed state and preferably has either an actuator 18, most preferably a solenoid 19, configured to adjust the valve 12 between the open and closed states, or at least a sensor (not shown) configured to sense when the valve 12 is (or should be) in the open state (e.g., a limit switch, etc.). The drain valves 12 are each configured to drain liquid from the connected separator chamber $C_S$ when in the open state or "open". Further, each pressure sensor 14 preferably includes a transducer 22 configured to generate an electrical signal $S_P$ corresponding to pressure $P_C$ within the separator chamber $C_S$ and to transmit the signal $S_P$ to the logic circuit 16. Preferably, each pressure sensor 14 is configured to sense pressure within the fluid line 5 extending between the associated separator 4 and connected compressor unit 2, which corresponds with the pressure $P_C$ within the chamber $C_S$ of the particular separator 4, but may alternatively be configured to directly sense the pressure $P_C$ within the separator chamber $C_S$ or even to sense a corresponding pressure within a section of the coupled compressor unit 2.

Furthermore, the logic circuit 16 is coupled with each one of the pressure sensors 14 and is preferably coupled with each one of the valve actuators 18 or valve sensors. The logic circuit 16 is configured (i.e., programmed, hardwired, etc.) to determine when each drain valve 12 has been, or at least should have been, adjusted to the open state or/and actually directs the "opening" of each valve 12, as discussed below. Also, the logic circuit 16 is further configured to generate an output signal $S_O$ (or to directly operate a device, as described below) either when the separator chamber pressure $P_C$ remains substantially constant or varies less than a predetermined amount (i.e., minimal pressure change), or/and when the pressure $P_C$ varies by at least a predetermined amount, subsequent to the one of more drain valves 12 being adjusted to the open state, as described in greater detail below.

Preferably, the drainage system 10 is constructed or configured such that the valve(s) 12 are automatically adjusted to the open state (and thus subsequently also to the closed state) periodically or repeatedly upon the expiration of a predetermined amount of time or time period during compressor operation, preferably by means of an associated actuator 18. In other words, system 10 is configured to open, and thereafter close, the valve(s) 12 in repeated time intervals, e.g., every fifteen minutes, every half hour, etc., so that the separator chamber(s) $C_S$ are intermittently drained continuously during compressor operation. Most preferably, the logic circuit 16 is further configured to direct the periodic opening and closing of each valve 12 by means of a control signal $S_C$ sent to the actuator 18 associated with the particular valve 12. However, the valve(s) 12 may alternatively be opened and closed by another logic circuit or controller (none shown) for directing opening of all the valves 12, or may be operated by an individual controller for each valve 12. In these alternative constructions, the logic circuit 16 would either be configured to merely determine or "track" when the valves 12 are scheduled to be opened (e.g., by a timing circuit, etc.) or may receive a feedback signal from a separately controlled valve actuator(s) 18 or a position sensor on a moveable valve element, whether or not the valve 12 has actually opened or fluid/liquid is permitted to flow through the valve 12, as discussed below.

In all the above or other cases, when the logic circuit 16 determines that the one or more valves 12 have opened or should have been opened, the logic circuit 16 uses pressure readings from the associated sensors 14 to determine if the separator chambers $C_S$ have been evacuated, which should result in a reduction of the pressure $P_C$ within each chamber $C_S$. As such, when the chamber pressure $P_C$ remains substantially constant or reduces only by a minimal amount, the logic circuit 16 is able to determine that the separator chamber $C_S$ has not been drained due to a malfunction of the associated actuator 18 or a component of the valve 12, a blockage in the valve 12 or a connected fluid line, etc. More specifically, the logic circuit 16 may send a control signal $S_C$ to the actuator 18 of each drain valve 12 or may receive a feedback signal from the associated actuator 18 that the actuator 18 has attempted to operate/open the associated valve 12, but one or more of the actuators 18 may malfunction or attempt to displace a valve closing element (e.g., spindle, etc.) that is immovable or "stuck". In other cases, the actuator(s) 18 may actually displace the valve closing element, but no flow passes therethrough because of an obstruction in a valve passage or a connected fluid line, etc.

Preferably, the logic circuit 16 is configured to at least generate a first output signal $S_{O1}$ when the chamber pressure $P_C$ of one or more separators 4 remains substantially constant or varies by less than a predetermined amount subsequent to the connected drain valve 12 being adjusted to the open state, either actually opened or when the actuator 18 receives a control signal $S_C$ that should have caused the valve 12 to be opened. Thus, the first output signal $S_{O1}$ is used to indicate a failure condition and/or to initiate corrective action, as discussed below. Further, the logic circuit 16 may also generate a second output signal $S_{O2}$ when the chamber pressure $P_C$ is reduced by a predetermined amount while each drain valve 12 is in the open state. As such, the second output signal $S_{O2}$ indicates that the connected chamber $C_S$ has been drained and the valves 12 and other drainage components (fluid lines, etc.) are functioning properly, as described below.

Thus, the logic circuit 16 is capable of determining when each particular drain valve 12 is functioning properly, i.e., the separator chamber pressure $P_C$ "drops" or is reduced by a predetermined amount, or that one or more drain valves 12 are malfunctioning, i.e., the pressure $P_C$ remains constant in the separator chamber $C_S$ associated with such valves 12. As mentioned above, such malfunctions include, but are not limited to, an actuator 18 not opening a valve 12 after receiving a control signal $S_C$ from the logic circuit 16, a blockage in a valve passage, a blockage in a fluid line between a chamber $C_S$ and a valve 12 or between a valve 12 and a discharge port (not depicted), or any other occurrence preventing liquid from evacuating a separator chamber $C_S$. In any case, when the logic circuit 16 determines that a malfunction has occurred such that at least one of the separators 4 has not been drained as required, the logic circuit 16 is preferably further programmed or constructed to take an appropriate "emergency" response or corrective action.

More specifically, when the pressure $P_C$ in any separator chamber $C_S$ does not drop by a certain amount, the logic circuit 16 is preferably configured to transmit the first output signal $S_{O1}$ to the one or more compressor motors 3 to thereby turn off the motor(s) 3, such that the compressor assembly 1 halts operation. Alternatively or additionally, the logic circuit 16 may be configured to directly operate one or more indicator devices 28, such as a warning light, horn, speaker, etc., or to send the output signal $S_{O1}$ to a monitoring device 29 (e.g., a display and/or controller) operably coupled with the logic circuit 16 and configured to provide a warning indication and/or create an event record (i.e., within a performance audit database) upon receipt of the signal $S_{O1}$. Therefore, either the logic circuit 16 automatically shuts down the compressor assembly 1, or provides an operator with the necessary information to enable the operator to take the appropriate action(s) upon the occurrence of a malfunction. Further, the logic circuit 16 may be constructed to first provide a warning to the operator, and then shut down the compressor assembly 1 upon expiration of a predetermined time period if no operator corrective action has occurred.

Preferably, the logic circuit 16 includes a microprocessor 24 electrically coupled with each one of the valve actuators 18 (or valve sensors 20) and with each one of the pressure sensors 14, the microprocessor 24 being configured to generate the one or more output signals $S_O$. Most preferably, the logic circuit 16 includes a programmable logic controller or "PLC" 26 providing the microprocessor 24 and configured to receive inputs from a plurality of the pressure sensors 14 and a plurality of the valve actuators 18 (or sensors 20), as best shown in FIG. 1. Alternatively, the logic circuit 16 may be provided by a separate microprocessor incorporated into a printed circuit board, so as to constitute a specially manufactured controller, a "hard-wired" analog electronic controller, a pneumatic or hydraulic logic device, or any other type of logic device capable of performing the logic and/or control operations as generally described herein.

Figure 3:
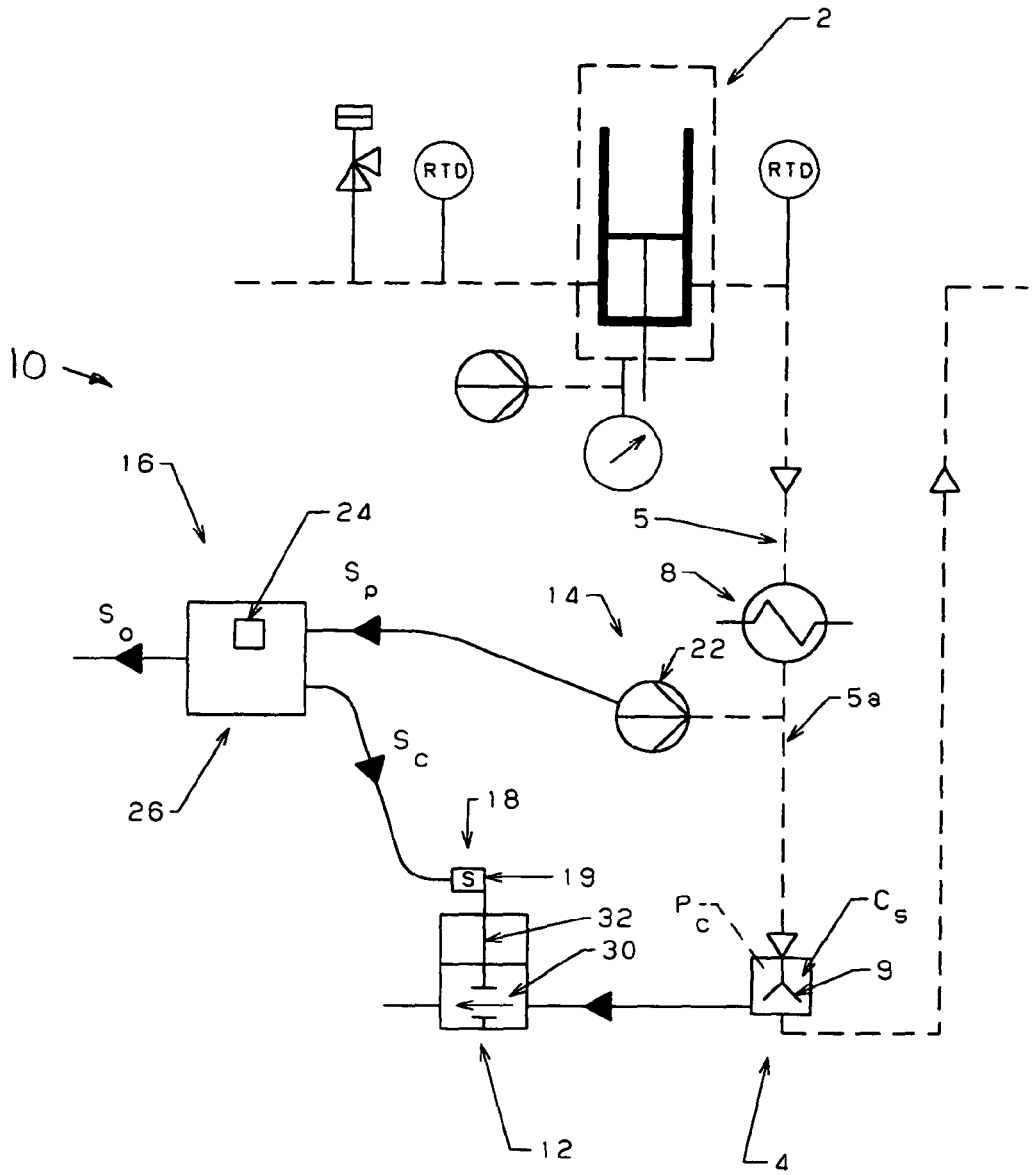
FIG. 3 is an enlarged, schematic view of a single stage of the compressor assembly of FIG. 1.
Figure 4:
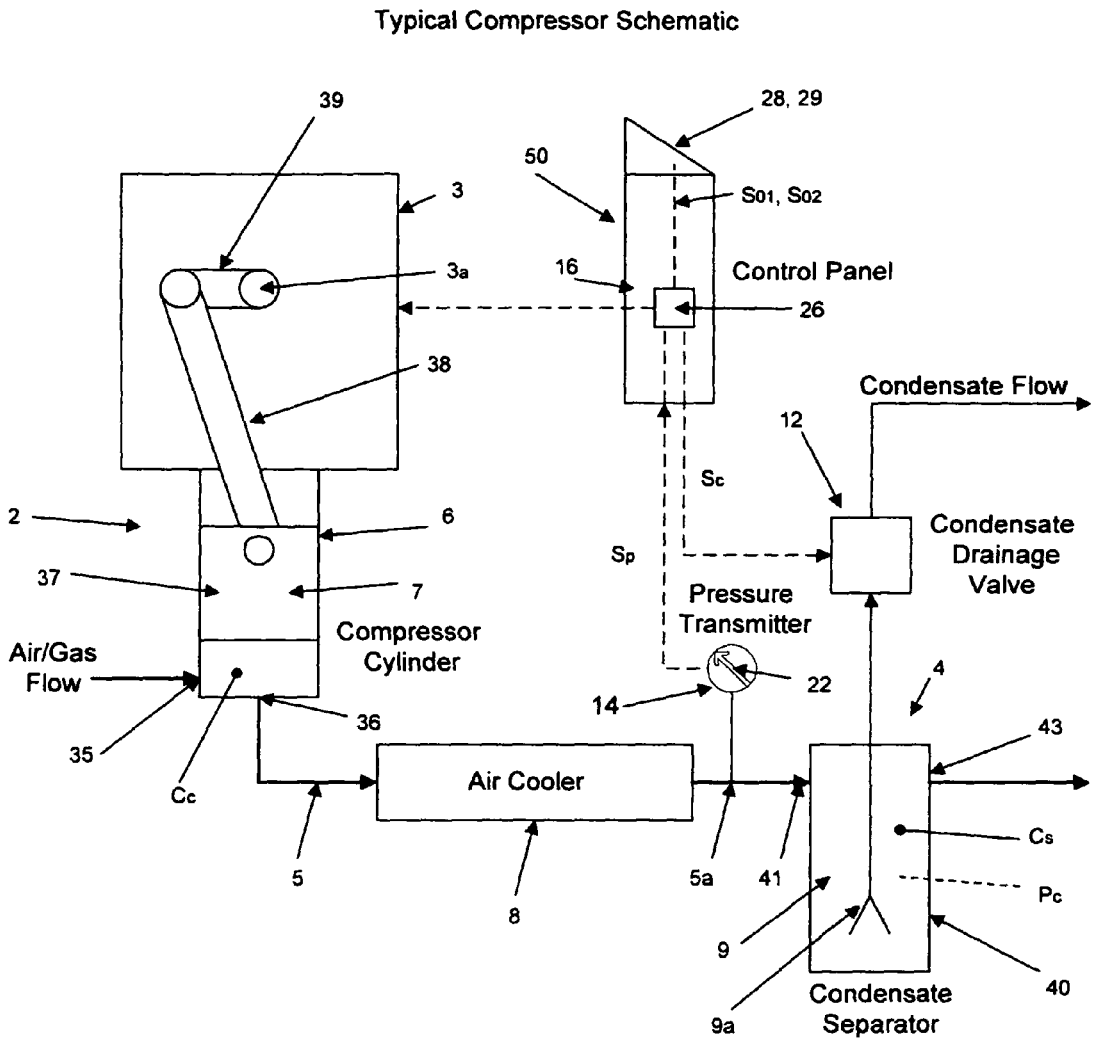
FIG. 4 is a schematic view of an exemplary compressor unit of a single compressor stage.
Figure 5:
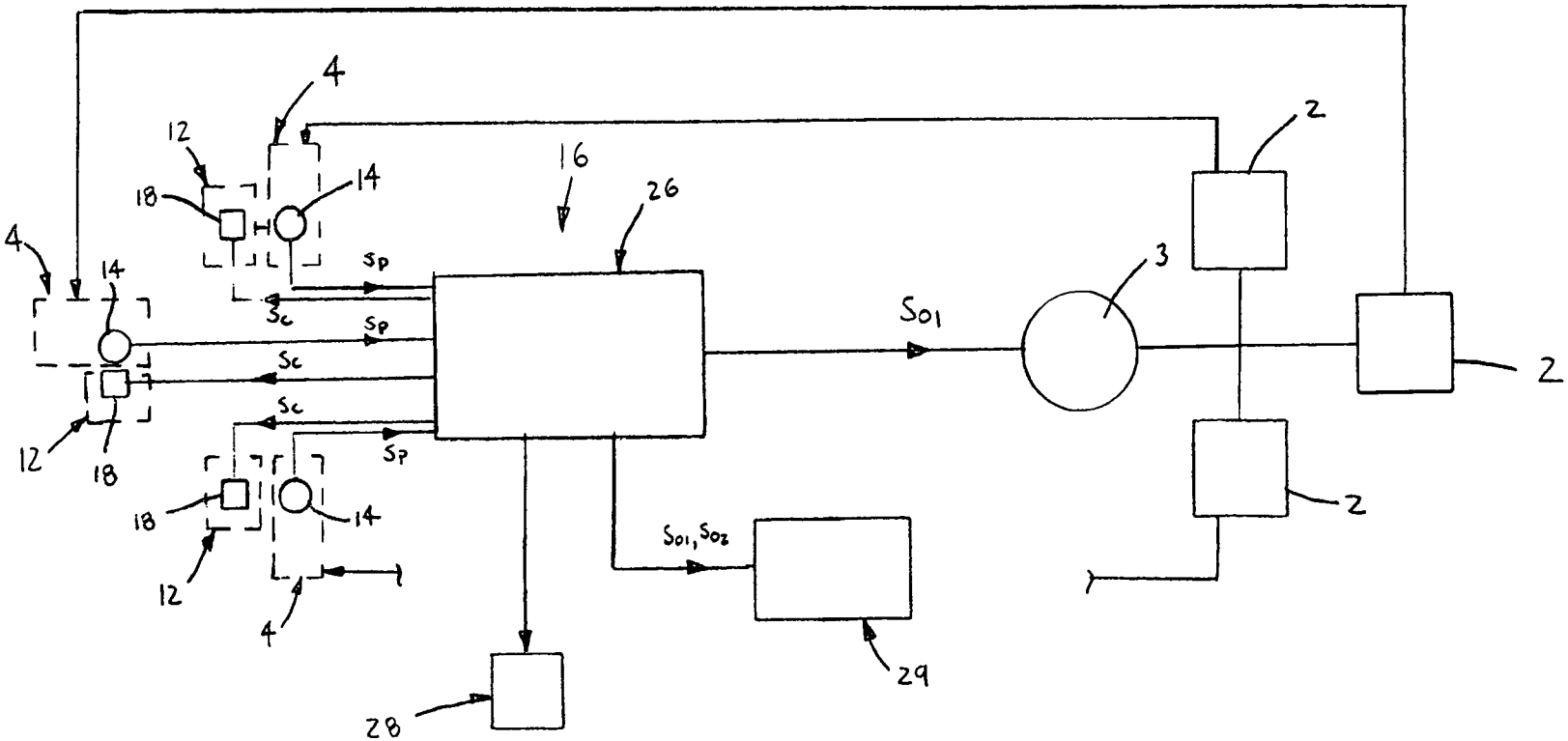
FIG. 5 is a block diagram of the basic components of the drainage system of the present invention.

Referring to FIGS. 3-5, the preferred PLC 26 is preferably configured to operate or adjust each valve 12 between the open and closed states, specifically by means of a valve control signal $S_C$ sent to the actuator 18 of the particular valve 12, as discussed above. Most preferably, the PLC 26 is programmed to adjust each one of the plurality of drain valves 12 to the valve open state, preferably periodically upon the expiration of a predetermined amount of time (e.g., every 10 minutes, one an hour, etc. during compressor operation) as discussed above, or alternatively when the PLC 26 determines that any separator chamber $C_S$ contains about a predetermined amount of liquid (e.g., a quarter gallon). With the PLC 26 actually controlling the operation of each drain valve 12 (i.e., the opening and closing thereof), the logic circuit 16 "knows" when each valve 12 is or should have been opened, such that no input to determine when the valve(s) 12 have been adjusted to the open state (whether or not actually opened) is required. However, with a compressor assembly 1 that has a separate device(s) for controlling the opening and closing of the valves 12, for example a controller (not shown) for each valve 12 receiving input from a floater sensor (not shown) to drain the chamber $C_S$ when a certain amount of fluid accumulates therein, or the valves 12 are manually operated, a separate valve sensor (none shown) may be necessary. For example, each drain valve 12 may have a limit switch (none shown) electrically connected with the PLC 26 that closes (and generates a signal) when a valve member 32 is moved to a valve open position, as discussed in greater detail below.

As best shown in FIG. 3, each drain valve 12 has a passage 30 fluidly connected with the associated separator chamber $C_S$ and a moveable valve member or "closing element" 32 (e.g. a stem, spindle, plug, etc.) configured to releasably obstruct the passage 30, as is well known. As discussed above, each valve 12 preferably includes a solenoid valve actuator 19, which is configured to displace the valve closing element 32 between a first position, at which the passage 30 is substantially obstructed (i.e., no fluid flow therethrough), and a second position at which the passage 30 is substantially open. The solenoid 19 is electrically coupled with the logic circuit 16, preferably with the PLC 26, such that the circuit 16 is able to control the opening/closing of each valve 12 and thus determines when a pressure drop should be detected by each pressure sensor 14. However, the valve actuators 18 may be provided by any other appropriate device, such as an electric, hydraulic or pneumatic motor, may be operated by a device(s) other than the logic circuit 16, or one or more of the drain valves 12 may be manually operated, for example by a hand-rotatable spindle.

Having described the basic elements and operation above, these and other components of the compressor drainage system 10 of the present invention, and preferred application(s), are described in detail below.

Referring to FIG. 1, as discussed above, the drainage system 10 of the present invention is preferably used with a multi-stage compressor assembly 1 that preferably includes a single housing or casing (not shown) containing each of the plurality of compressor units 2, but may include one or more housing/casing sections each containing one or more compressor units 2 and connected by appropriate means. Each drain valve 12 is connected with the housing or casing so as to direct fluid to flow externally of the housing, i.e., the valves 12 evacuate fluid from the compressor housing. The compressor assembly 1 also has an inlet port $I_P$ and an outlet port $O_P$, such that fluid enters the housing through the inlet port $I_P$, passes through each stage of the compressor assembly 1 and exits the housing through the outlet port $O_P$. Although the drainage system 10 is preferably used with a multistage compressor assembly contained in a single housing/casing, it is within the scope of the present invention to use the drainage system 10 with only a single stage compressor or a multistage compressor assembly 1 that includes compressor units 2 each contained within two or more separate housings or casings.

Referring to FIGS. 1 and 4, each compressor unit 2 includes a moveable compression member 6, preferably a reciprocable piston 7 but may alternatively be a rotatable impeller or a screw (neither shown), operatively connected with the motor(s) 3. The compressor assembly 1 preferably includes only a single motor 3 for simultaneously displacing the compression members 6 of all of the compressor units 3, for example through a common drive shaft 3*a*. However the compressor assembly 1 may alternatively include a plurality of motors 3, particularly if the compressor assembly 1 includes a number of distinct, but fluidly connected, compressor units 2. Further, each of the preferred reciprocal compressor units 2 preferably includes a compression chamber $C_C$ defined within the compressor housing and having an inlet port 35 and an outlet port 36, a piston head 37 disposed within the chamber $C_C$, and a connecting rod 38 extending between the piston head 37 and a crank member 39 on the drive shaft 3*a*. However, the compressor units 2 may be of any appropriate type and have any appropriate structure, and the scope of drainage system 10 of the present invention is in no manner limited to any particular type of compressor unit 2.

Preferably, the compressor assembly 1 also includes a plurality of coolers 8 that are each either disposed about, or fluidly connected with, a portion of each fluid line 5, such that the compressed fluid is cooled prior to separation of the liquid therefrom. Each pressure sensor 14 is preferably configured to sense fluid pressure in a section 5*a* of the fluid line 5 extending between one cooler 8 and the associated separator 4.

As best shown in FIGS. 3 and 4, each separator 4 preferably includes a condenser member 9 having at least one surface 9*a* for condensing liquid from the compressed fluid flowing through the separator 4, such as for example one or more baffles. More specifically, each separator 4 preferably includes a housing 40 defining the separator chamber $C_S$ and having an inlet 41 and an outlet 43, the associated drain valve 12 being mounted to the housing 40, or connected thereto by a fluid line (not indicated), and the preferred condenser member(s) 9 are disposed within the chamber $C_S$. As such, compressed fluid flows into the inlet 41, contacts the condenser member(s) 9 so that liquid condenses thereon to separate from the gaseous component of the fluid, and the remaining fluid flows out of the outlet 43. Alternatively, each separator 4 may include a rotatable member, such as a generally tubular drum (none shown), configured to direct liquid generally radially and tangentially outwardly from a central axis so as to separate liquid from a gaseous remainder of the fluid (i.e., a centrifugal separator), or any other appropriate device for separating liquid from a fluid flow.

Figure 2:
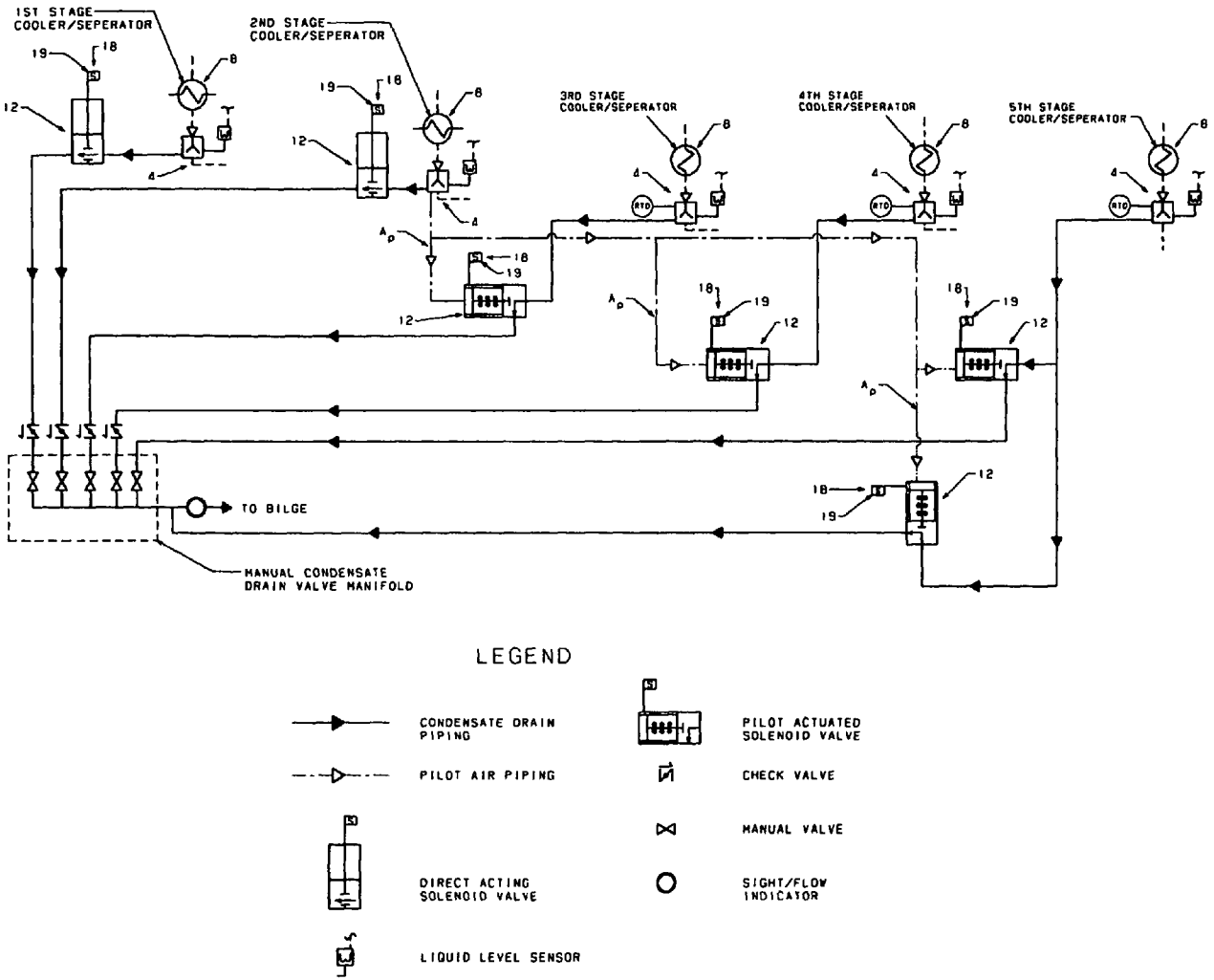
FIG. 2 is another schematic view of the multistage compressor of FIG. 1.

Referring to FIGS. 1 and 2, in one preferred application of the compressor drainage system 10, the compressor assembly 1 includes five compression stages, each stage include a reciprocal compressor unit 2, a separator 4, and a cooler 8 disposed generally between each compressor unit 2 and associated separator 4. Preferably, the drain valves 12 of the first two stages have solenoids 19 that are configured to close automatically after a predetermined amount of time (e.g., twelve seconds) after the compressor assembly starts operating, and the valves 12 of the third, fourth and fifth stages have solenoids 19 that are closed by a pilot air flow $A_P$ from the compressor second stage, as indicated in FIG. 2. These drain valves 12 of the third, fourth and fifth stages vent off the pilot air pressure upon receipt of the control signal $S_O$ from the PLC 26, to thereby enable these valves 12 to open and drain the connected separator 4. Most preferably, each drain valve 12 includes an ASCO bulletin 8262 style, pilot-operated solenoid valve.

Referring to FIG. 3, the preferred PLC 26 is preferably provided by a commercially available control panel 50, most preferably an Allen Bradley SLC5 based control panel, located in an appropriate operator station or area. However, the PLC 26 may be provided by a separate controller unit of any appropriate construction. Preferably, any indicator or monitoring devices are preferably also incorporated in the contained within a control panel 50, but may also be provided by separate devices. Further, each pressure sensor 14 is preferably a diaphragm pressure transducer 22, and most preferably an AMETEK Style A2 pressure transmitter commercially available from AMETEK U.S. Gauge of Feasterville, Pa., exposed to fluid flow within the fluid line 5 and electrically connected with the preferred PLC 26. Although a diaphragm pressure transducer 22 is presently preferred, any other type of pressure transducer or sensor may alternatively be used, such as for example, a transducer utilizing a Bourdon tube, a capsule or bellows as the mechanical element being sensed for displacement proportional to fluid pressure.

With the basic structure as described above, the compressor drainage system 10 functions basically in the following manner. Once operation of the compressor assembly 1 is initiated, the valves 12 are generally arranged in the closed state while fluid flowing through the compressor assembly 1, particularly gaseous portions thereof, substantially passes from the compressor inlet port $I_P$ valve and out of the compressor outlet port $O_P$. However, as discussed above, the drain valves 12 are periodically opened to evacuate the liquid accumulating within the associated separators 4, preferably automatically at specified time intervals by control signals $S_C$ sent to the valve actuators 18 from the PLC 26, as described above. Upon opening each drain valve 12, the PLC 26 may generate the second output signal $S_{O2}$ when the valves 12 function properly and evacuate the liquid, or may ignore pressure signals within the desired range and take no further action when an appropriate pressure drop occurs. However, when the PLC 26 determines that the pressure $P_C$ within one or more separator chambers $C_S$ remains substantially constant, or has not experienced a sufficient drop, when the associated valve 12 should have opened, the PLC 26 preferably generates the first output signal $S_{O1}$ such that the compressor assembly 1 is shut down or/and an appropriate warning is provided to enable an operator to take appropriate remedial action.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as generally defined in the appended claims.

We claim:

1. A method of draining a separator coupled to a compressor, comprising:

determining a first pressure in at least one of the compressor, the separator, and a line extending between the compressor and the separator;

determining when the separator contains about a predetermined amount of liquid before signaling a drain valve to open;

signaling the drain valve to open to drain the separator;

determining a second pressure in the at least one of the compressor, the separator, and the line after signaling the drain valve to open; and initiating corrective action if the second pressure is less than the first pressure by less than a predetermined amount, wherein initiating corrective action comprises signaling a drain failure with an indicator device.

2. The method of claim 1, further comprising signaling the drain valve to close after signaling the drain to open, if the second pressure is less than the first pressure by greater than or equal to the predetermined amount.

3. The method of claim 1, wherein signaling the drain valve comprises sending an electrical signal from a programmable logic controller to an actuator of the drain valve.

4. The method of claim 3, further comprising receiving a position feedback signal from the drain valve with the programmable logic controller after signaling the drain valve to open, wherein the position feedback signal indicates whether the drain valve has opened.

5. The method of claim 1, wherein determining the first and second pressures comprises receiving electrical signals from a pressure transducer disposed in the at least one of the compressor, the separator, and the drain.

6. The method of claim 1, wherein initiating corrective action comprises shutting down a motor driving the compressor.

7. The method of claim 1, wherein initiating corrective action further comprises shutting down a motor driving the compressor if an operator does not take additional corrective action within a predetermined amount of time after signaling the drain failure with the indicator device.

8. A method for draining a separator fluidly coupled to a compressor, comprising:

periodically sending an opening signal to a drain valve coupled to the separator to drain a condensate stored in the separator, wherein periodically sending the opening signal comprises periodically sending an electric signal to an actuator of the drain valve, wherein each electric signal is separated from a subsequent electric signal by a substantially constant time interval;

periodically sending a closing signal to the drain valve to maintain pressure in the separator;

periodically receiving a feedback signal from a sensor coupled to the actuator to determine a drain valve position;

determining a pressure drop in the separator after sending each opening signal to the drain valve; and initiating corrective action if the pressure drop is below a predetermined amount.

9. A method for draining a separator fluidly coupled to a compressor, comprising:

periodically sending an opening signal to a drain valve coupled to the separator to drain a condensate stored in the separator;

periodically sending a closing signal to the drain valve to maintain pressure in the in the separator;

determining a pressure drop in the separator after sending each opening signal to the drain valve; and initiating corrective action if the pressure drop is below a predetermined amount, wherein initiating corrective action comprises shutting down a motor driving the compressor.

10. The method of claim 9, wherein initiating corrective action comprises:

signaling a drain failure with an indicator device; and shutting down the motor after signaling the drain failure if an operator does not take additional corrective action.

11. The method of claim 8, wherein determining the pressure drop comprises taking a pressure reading in a line extending between the compressor and the separator.

12. The method of claim 8, wherein initiating corrective action comprises:

signaling a drain failure with an indicator device; and shutting down the motor after signaling the drain failure if an operator does not take additional corrective action.

13. The method of claim 9, wherein determining the pressure drop comprises taking a pressure reading in a line extending between the compressor and the separator.

14. The method of claim 9, wherein periodically sending the opening signal to the drain valve comprises periodically sending an electric signal to an actuator of the drain valve, wherein each electric signal is separated from a subsequent electric signal by a substantially constant time interval.

15. The method of claim 14, further comprising periodically receiving a feedback signal from a sensor coupled to the actuator to determine a drain valve position.

* * * * *